United States Patent [19]

Reed et al.

[11] Patent Number: 4,659,259

[45] Date of Patent: Apr. 21, 1987

[54] METHOD AND DEVICE FOR MIXING STABILIZING CHEMICALS INTO EARTHEN FORMATIONS

[75] Inventors: Marion G. Reed, Hacienda Heights; James B. Gibson, Placentia, both of Calif.

[73] Assignee: Chevron Research Company, San Francisco, Calif.

[21] Appl. No.: 658,959

[22] Filed: Oct. 9, 1984

[51] Int. Cl.[4] ..... E02D 3/12

[52] U.S. Cl. ..... 405/263; 405/269

[58] Field of Search ..... 405/236, 240, 241, 242, 405/258, 263, 264, 266, 267, 269, 270, 271

[56] References Cited

U.S. PATENT DOCUMENTS

| | | | |
|---|---|---|---|
| 935,081 | 9/1909 | Wolfsholz | 405/266 |
| 2,782,605 | 2/1957 | Wertz et al. | 405/269 X |
| 3,023,585 | 3/1962 | Liver | 405/269 X |
| 3,243,962 | 4/1966 | Ratliff | 405/269 X |
| 3,802,208 | 4/1974 | Granholm et al. | 405/269 |
| 3,875,751 | 4/1975 | Paus | 405/263 |
| 3,969,902 | 7/1976 | Ichise et al. | 405/267 |
| 4,063,424 | 12/1977 | Takagi et al. | 405/269 X |
| 4,072,017 | 2/1978 | Shiraki | 405/269 X |
| 4,360,599 | 11/1982 | Loken et al. | 405/263 X |
| 4,394,213 | 7/1983 | Fern | 405/263 X |

FOREIGN PATENT DOCUMENTS

| | | | |
|---|---|---|---|
| 693642 | 7/1940 | Fed. Rep. of Germany | 405/269 |
| 1357603 | 6/1974 | United Kingdom | 405/263 |
| 694595 | 11/1979 | U.S.S.R. | 269/ |

*Primary Examiner*—Cornelius J. Husar
*Assistant Examiner*—Nancy J. Stodola
*Attorney, Agent, or Firm*—S. R. LaPaglia; E. J. Keeling

[57] ABSTRACT

A method and device for properly mixing stabilizing chemicals into earthen formations. A helical blade of one or more convolutions is attached to a hollow torque tube and rotated down into the soil. As the device is rotated through the soil to be stabilized, chemicals are pumped down the torque tube, out the device, and then mixed into a soil column by the rotating action of the device.

2 Claims, 4 Drawing Figures

METHOD AND DEVICE FOR MIXING STABILIZING CHEMICALS INTO EARTHEN FORMATIONS

The present invention relates to infusing and mixing a stabilizing chemical into an earthen formation. The invention described is particularly applicable as a method and device which creates a disturbed column in a quick clay formation and then infuses and properly mixes a stabilizing chemical, such as hydroxy-aluminum, into the disturbed column in order to stabilize the quick clay.

BACKGROUND OF THE INVENTION

Many clay deposits often need to be stabilized before they can carry any additional load such as is applied during filling and construction activities. This is specially true for the so-called quick clays which frequently are found, for example, in northern Soviet Union, Scandinavia, Canada, upper New York State, and New Zealand. Clays were originally deposited in marine and brackish water in a short period after the last glaciation, and later during the continental (isostatic) uplift were raised above sea level. However, only certain of these clay deposits were subsequently changed into sensitive quick clays. Two processes are mainly responsible for such a change. The original pore water salt content of the clay may have been leached by percolating ground water, or organic matter from logs or marshes which will act as dispersing agents may have been introduced into the clay. The first process has been most important in clays found in Norway, while quick clays containing high organic content formed by the second process are frequently found in Sweden and Canada.

The quick clays will in the undisturbed state exhibit a certain limited strength, but will upon remoulding completely liquify. This same phenomena has caused several quick clay slides in the lowlands of eastern and middle Norway, often with catastrophic consequences. Heretofore, several chemical stabilization schemes have been tried for such clays. Among them were aluminum chloride ($AlCl_3$) and potassium chloride (KCl). The quick clays have been stabilized in two ways. The clay can be mixed and remoulded with the chemicals, or the chemicals can be allowed to diffuse into the undisturbed quick clay. The disadvantage of the salt diffusion method is the long time it takes to reach the required penetration. The diffusion method has been applied only once, so far as is known, in full scale in the field, when salt wells containing KCl were installed two years prior to a major highway construction.

One method for deep stabilization is the infusion of unslacked lime (CaO) into the soil. Lime is an old stabilizing agent that was used centuries ago as a construction material. In the U.S.A. in the 1940's and Europe in the 1950's lime was used as a surface stabilizing agent. The deep stabilization method involves mixing and molding the lime with the clay to form a series of piles which extend down into the clay. These piles provide lateral stabilization to the clay deposit.

Hydroxy-aluminum [$Al(OH)_{2.5}Cl_{0.5}$] alone and in combination with chemicals such as potassium chloride (KCl) is disclosed as a clay stabilizing agent in U.S. Pat. No. 4,360,599 issued to Tor Loken and Odd R. Bryhn on Nov. 23, 1982. The same patent describes the need for proper admixing of the stabilizing agent into the clay in order to achieve the desired results. Some stabilizing chemicals such as hydroxy-aluminum have more stringent mixing requirements than unslacked lime. Existing mixing devices and methods are functional but do not consistently provide the precise mixing required to produce desired results. There still is a need for an improved method and device for properly mixing stabilizing chemicals into clay soil.

SUMMARY OF THE INVENTION

The present invention is a method for stabilizing a clay deposit (particularly quick clay) by creating a disturbed column and infusing a stabilizing chemical by means of an in-situ mixing device. The device is comprised of a helical blade of one or more convolutions attached to a hollow torque tube. Means are provided to rotate the tube and to supply vertical travel. The device is rotated down into the clay and a stabilizing chemical such as hydroxy-aluminum is pumped down the torque tube and into the formation while the blade is rotated. The blade may have bypass channels in the convolutions to permit backflow thereby furthering the mixing process. The device is moved up through the formation with the blade rotating faster than the thread speed while the stabilizing chemical is pumped out the device and thoroughly mixed into the clay. The present invention is particularly suitable for mixing hydroxy-aluminum into quick clay because the reaction of the hydroxy-aluminum with the quick clay is not spontaneous; therefore, hydroxy-aluminum may be infused into the clay both on the downward travel and upward travel of the blade.

The continuous and sturdy helical configuration of the device provides the capability of turning through the ground crust diverting or deflecting rocks and obstructions without damage to the device. Rotational speed, vertical travel speed, and rotational direction are all controlled at the surface and can be varied to optimize the mixing process.

DETAILED DESCRIPTION OF THE INVENTION

Figure 1:
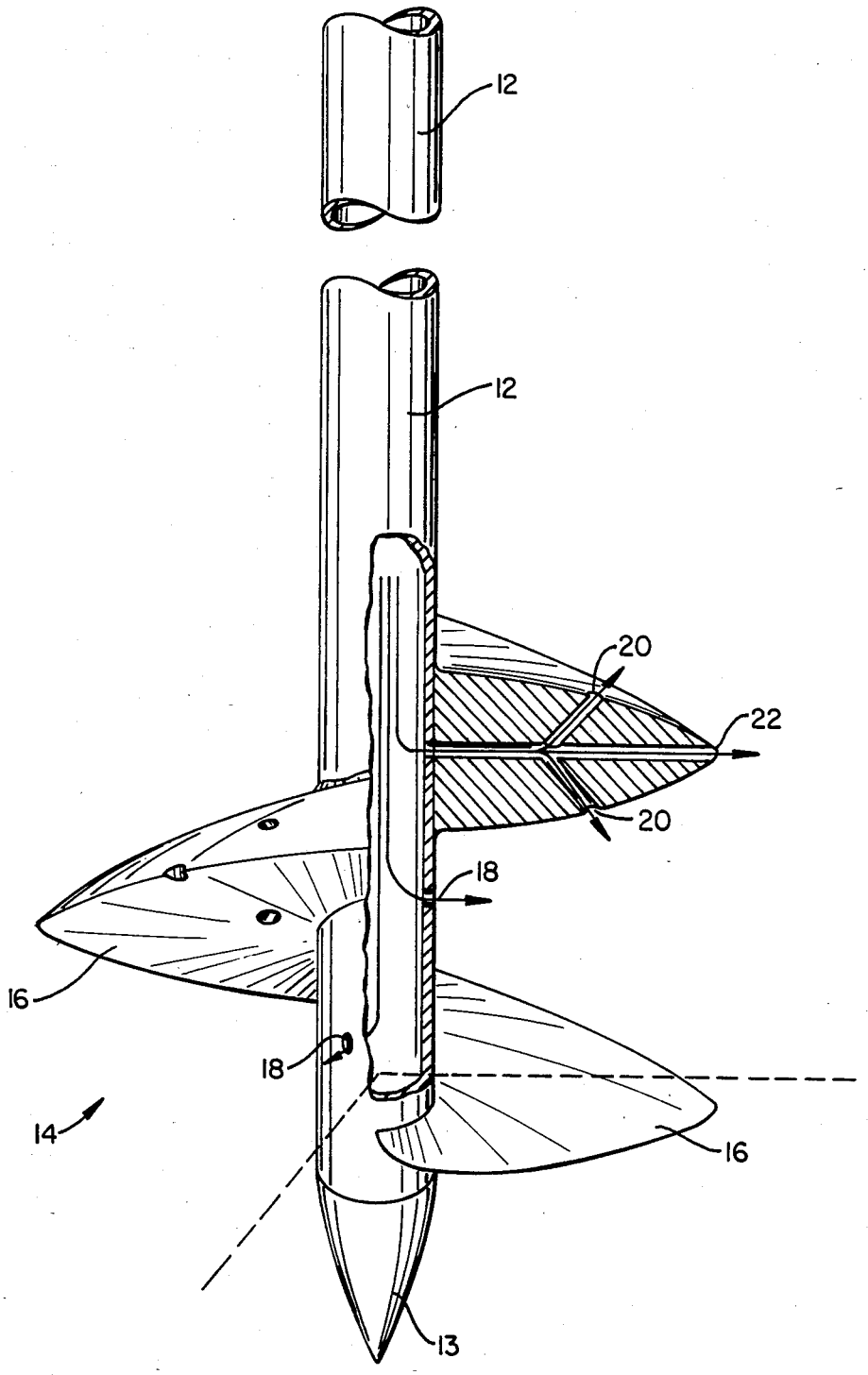
FIG. 1 illustrates basic design of the in-situ mixing device including a cut away view of possible exit port locations.

The invention will be more clearly illustrated by referring to the drawings. FIG. 1 illustrates an in-situ mixing device 14 connected at the end of a hollow torque tube 12. A helical blade 16 of one and one half convolutions is attached to torque tube 12. Exit ports are placed on torque tube 12 to allow chemical to flow out the torque tube 12 and into the formation 30. The exit ports may be located on the torque tube 12 between the convolutions of the helical blade 16 (as shown by port 18) or on the convolutions of the helical blade 16 themselves (as shown by ports 20 & 22).

Figure 2:
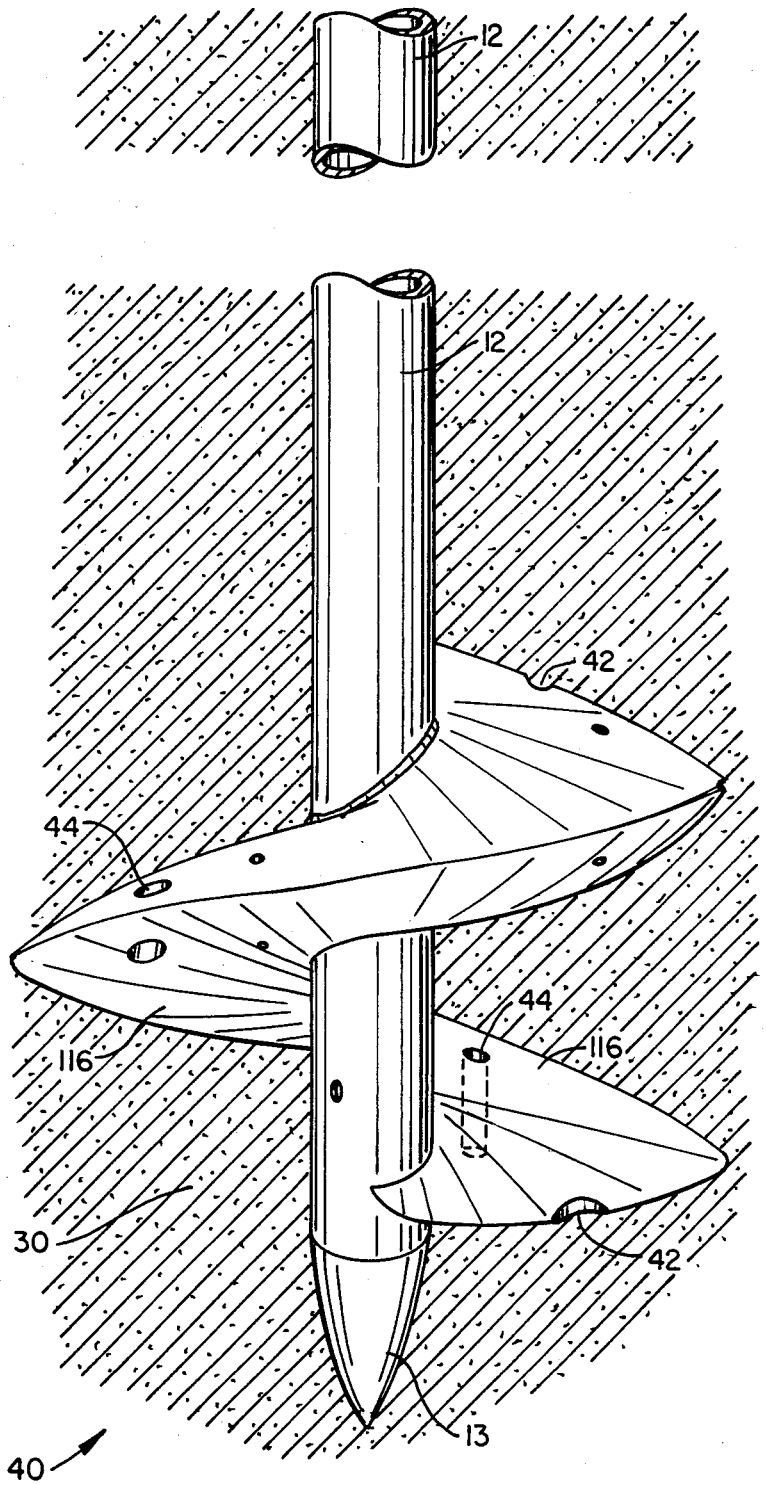
FIG. 2 is an alternate embodiment of the in-situ mixing device including bypass channels.

FIG. 2 illustrates an alternative mixing device 40 having bypass channels on the convolutions of the helical blade 116. The bypass channels permit clay and stabilizing chemical to recirculate back through the mixing device 40 as it is rotated through the clay 30. The bypass channels may be located on the edge of the convolutions of the helical blade 116 (as shown by channel 42) or internally (as shown by channel 44).

Figure 3:
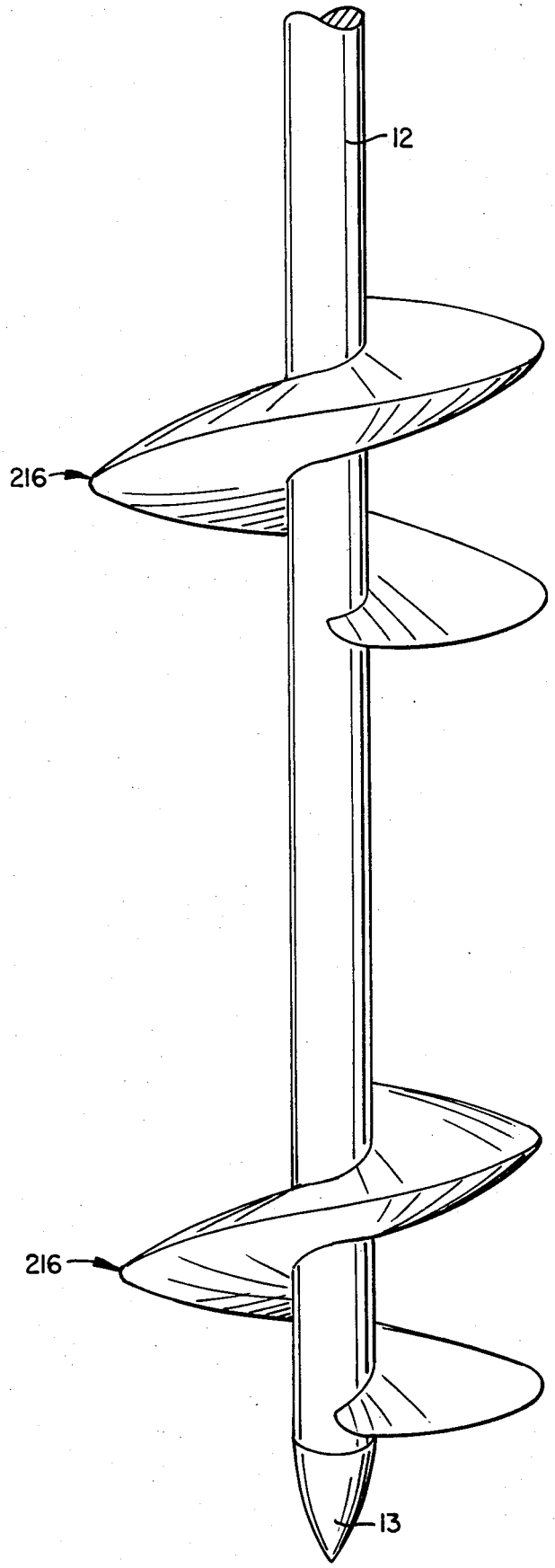
FIG. 3 is an alternate embodiment of the in-situ mixing device including multiple blades.

Alternate mixing device designs are not limited to the constant diameter one and one-half convolution helical blade 16 of FIG. 1. In accordance with a broad aspect of the invention, the helical blade is comprised of one or more convolutions (or fractions thereof) of varying diameter or pitch. FIG. 3 illustrates an alternate mixing device which has two helical blades 216 each having more than one convolution. A single torque tube 12 may accommodate several helical blades 216 in such a fashion.

A pointed tip 13 on the torque tube 12 may be threaded or smooth, acting as a locator or centralizer for the mixing device 14. Optionally, the tip 13 may be removable. Since the tip 13 is the leading point of the mixing device 14, it is subject to heavy wear and may require more frequent replacement than the remaining parts.

The helical blade has a shape similar to a pump impeller (refer to FIG. 1 and FIG. 2). Such a blade may be constructed by a suitable impeller manufacturer. The preferred method of construction has the convolutions of the helical blade 16 and 116 made from mild carbon steel plate of approximately ¼" thickness. Two disks of appropriate diameter are cut out with a center hole for the torque tube 12. A spiral is cut in each disk which is then stretched into a helical shape. The two helixes are then welded at the center to the hollow torque tube 12 and together at their outer edges. Final machining processes provide a smooth surface, bypass channels 42 and 44, and exit ports 18, 20, and 22.

The preferred method for making the bypass channel 42 on the edge of a convolution of the helical blade 116 is simply cutting out a section of the metal. The gap between the upper and lower sides of the convolution of the helical blade 116 is filled by weld buildup. The area is then machined to a smooth surface. Internal bypass channels 44 are formed by cutting holes in the upper and lower sides, inserting a pipe which has the same diameter as the holes, and welding the pipe ends flush to the surfaces of the blade 116.

Alternately the entire helical blade 16 or 116 may be forged and machined from a single piece of metal and then welded to the hollow torque tube. Such a method will produce a device of superior strength, though possibly at a higher cost. Other methods of construction may appear obvious to one skilled in the art.

A bead of some harder metal material may be applied to the leading edges of the blade which is subject to most severe wear. The remainder of the blade being constructed of mild carbon steel is more ductile which reduces damage and avoids catching rocks while drilling through soil.

Figure 4:
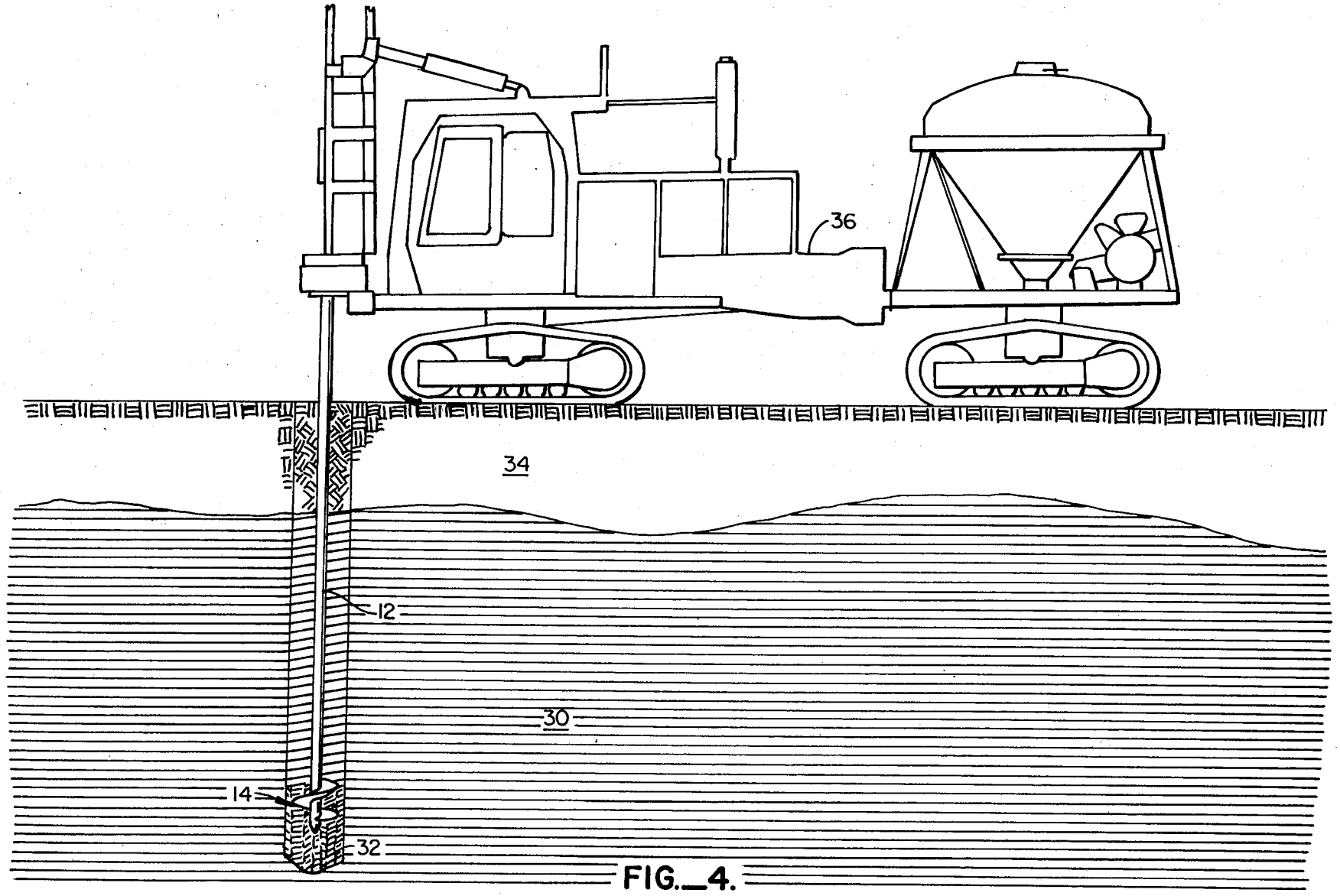
FIG. 4 illustrates the mixing method of the present invention.

FIG. 4 illustrates a method of the present invention for stabilizing an earthen formation 30 such as quick clay by creating a disturbed column 32 in the quick clay 30 and infusing a stabilizing chemical such as hydroxy-aluminum by means of the in-situ mixing device 14. The mixing device 14 is rotated through the upper crust 34 and down to the bottom of the quick clay 30. The device is then rotated and moved up through the formation at a vertical travel speed slower than the thread rate while the stabilizing chemical such as hydroxy-aluminum is pumped down the torque tube 12 through the exit ports and into the quick clay where it is thoroughly mixed therein by the rotating mixing device 14. Means for applying and controlling vertical and rotational motion are supplied from surface equipment 36. Such surface equipment is available from Linden-Alimak AB, 5-93103 Skelleftea, Sweden. Linden-Alimak, a company which provides soil stabilization services, has existing surface equipment readily adaptable for use with the present invention.

Mixing is accomplished when rotating the device 14 at a speed different than the thread speed. The thread speed is the rotational speed at which the convolutions of the helical blade 16 and 116 would rotate through the earth much as a screw turns through wood. When the device 14 is rotated faster than the thread rate or rotated in place, the device 14 pushes formation material behind itself. Since the material has nowhere to go, it must recirculate, slipping back around the outer edges of the blade. The bypass channels 42 and 44 may permit additional recirculation thereby facilitating the mixing action.

The stabilizing chemicals may be infused while the mixing device 14 is rotated in place, rotated up through the formation, or rotated down through the formation. Vertical travel speed, rotational speed and direction of the mixing device 14 may be varied to optimize mixing. To achieve optimum mixing action, the device may be rotated at speeds different than the thread speed. The preferred method is to rotate the device faster than the thread speed in order to provide more thorough mixing action. If a column of a formation such as quick clay becomes liquified as the mixing device 14 is rotated down through the formation, the mixing device 14 may be moved upward through the formation rotating in a direction opposite the thread direction to provide more vigorous mixing action. The mixing device 14 may also be moved vertically in a reciprocating motion to further the mixing process.

Actual mixing procedure will depend on the formation properties. When stabilizing Norwegian quick clay with hydroxy-aluminum, for example, the hydroxy-aluminum reacts slowly and may be infused into the formation as the mixing device is rotated down through the formation. Mixing may then occur both in downward and upward travel. When stabilizing some clay formations with lime, the chemical reaction is almost immediate. The lime must be infused on the upward travel since once the lime is mixed, the clay quickly hardens.

Optionally a pressure of 15–20 psi of water or preferably air may be applied to the torque tube 12 (and the exit ports 18, 20, & 22) to prevent intrusion of soil while drilling. Alternately the torque tube 12 and the exit ports 18, 20, & 22 may require flushing to remove soil plugging.

U.S. Pat. No. 4,360,599 issued to Tor Loken and Odd R. Bryhn reveals a clay stabilizing technique by mixing specific dry chemicals into the clay. The mixing device of the present invention may accommodate dry chemicals by pumping those chemicals in an air stream down the torque tube 12 out the exit ports 18, 20, & 22 and into the formation 30. Alternately, a liquid solution of stabilizing chemical may be readily pumped down the torque tube 12 and into the formation 30 using a liquid pump.

Although only specific embodiments of the present invention have been described in detail, the invention is not limited to, but is meant to include all embodiments within the scope of the appended claims.

What is claimed is:

1. An in-situ mixing device for introducing and mixing hydroxy-aluminum into quick clay formations comprising:

a helical blade having convolutions of at least one revolution and having a central opening therethrough, said convolutions having substantial thickness adjacent said central opening and tapering to an outer edge;

a hollow torque tube having one end inserted through said central opening of said helical blade and fixedly connected therein;

exit ports in said torque tube;

means for pumping the hydroxy-aluminum through the hollow torque tube, out the exit ports and into the formation;

means connecting said pumping means to the upper end of said torque tube;

means for rotating said torque tube;

means for controlling the vertical travel speed of said torque tube;

means for rotating the helical blade at a speed different than thread speed; and bypass channels in the convolutions of said helical blade to permit flow of material thorugh said helical blade when said helical blade is rotated in the formation.

2. A method for infusing a hydroxy-aluminum mixture into a quick clay formation by means of an in-situ mixing device, comprising the steps of:

(a) rotating a hollow torque tube with a helical blade having convolutions of at least one revolution attached thereto down into the formation, said convolutions having substantial thickness adjacent said torque tube and tapering to an outer edge;

(b) creating a disturbed column in the formation and flowing the hydroxy-aluminum down the torque tube to the helical blade and into the formation;

(c) rotating said torque tube and helical blade in place thereby mixing the hydroxy-aluminum into the formation;

(d) rotating out said helical blade from the formation and allowing the formation to stabilize; and (e) permitting backflow through bypass channels in the convolutions of said helical blade.

* * * * *